US006329623B1

(12) United States Patent
Yan et al.

(10) Patent No.: US 6,329,623 B1
(45) Date of Patent: Dec. 11, 2001

(54) ELECTROSTATIC SEPARATION APPARATUS AND METHOD USING BOX-SHAPED ELECTRODES

(75) Inventors: Eric S. Yan, Orange Park; Thomas J. Grey, Jacksonville; Timo U. Niitti, Ponte Vedra, all of FL (US)

(73) Assignee: Outokumpu Oyj (FI)

( * ) Notice: Subject to any disclaimer, the term of this patent is extended or adjusted under 35 U.S.C. 154(b) by 0 days.

(21) Appl. No.: 09/603,271

(22) Filed: Jun. 23, 2000

(51) Int. Cl.[7] ..... B03C 7/12
(52) U.S. Cl. ..... 209/129; 209/127.1; 209/131
(58) Field of Search ..... 209/127, 128, 209/129, 137

(56) References Cited

U.S. PATENT DOCUMENTS

| | | | | |
|---|---|---|---|---|
| 2,283,964 | * | 5/1942 | Wyckoff | 95/79 |
| 3,256,985 | * | 6/1966 | Carpenter | 209/129 |
| 3,308,948 | * | 3/1967 | Barthelemy | 73/23.2 |
| 4,172,028 | * | 10/1979 | Dunn | 209/12.2 |
| 4,743,362 | * | 5/1988 | Pfoh et al. | 209/127.4 |
| 4,797,201 | * | 1/1989 | Kuppers et al. | 209/127.4 |
| 5,161,696 | * | 11/1992 | Seider | 209/127.4 |
| 5,251,762 | * | 10/1993 | Taylor et al. | 209/127.4 |
| 5,454,472 | * | 10/1995 | Benecke et al. | 209/127.1 |
| 5,484,061 | * | 1/1996 | Dunn | 209/127.4 |
| 5,885,330 | * | 3/1999 | Lee | 95/69 |
| 6,011,229 | * | 1/2000 | Geisler et al. | 209/127.4 |

* cited by examiner

*Primary Examiner*—Donald P. Walsh
*Assistant Examiner*—Daniel K Schlak
(74) *Attorney, Agent, or Firm*—Arthur G. Yeager

(57) ABSTRACT

This invention relates to an apparatus and method for electrostatically separating particles having different electrostatic properties. The apparatus involves two thin box-shaped electrodes facing each other as mirror-images and charged with a voltage field causing the opposing electrodes to assume opposite charges, and then passing a mixture of particles through the field so as to make the particles travel toward the respective electrodes through a perforated plate or screen and to a solid back plate and then to fall by gravity through a splitter adjusted to separate particles attracted by one charge from particles attracted by another charge. A vibrator is attached to each electrode, which is isolated for movement by spaced vibration isolators to shake off any particles stuck to the electrodes.

20 Claims, 4 Drawing Sheets

ELECTROSTATIC SEPARATION APPARATUS AND METHOD USING BOX-SHAPED ELECTRODES

CROSS-REFERENCE TO RELATED APPLICATIONS

The present application is related to application Ser. No. 09/096,863 filed by A. H. Jackson on Jun. 12, 1998, entitled "ELECTROSTATIC SEPARATION OF PARTICLES".

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to the field of electrostatic separation of particles; and more particularly, it relates to novel electrodes for use in electrostatic separation methods.

2. Related Art

The art related to this invention describes different sizes, shapes, and arrangements of electrostatic electrodes used for the separation of particles having any of a variety of different electrostatic charges. None of the prior art teaches such an electrode having a thin, rectangular box-shape such as that taught by the present invention.

The closest related art is found in U.S. Pat. No. 5,251,762, which was issued Oct. 12, 1993 to J. B. Taylor and A. H. Jackson and assigned to the assignee of the present invention; and U.S. Ser. No. 09/096,863, filed by A. H. Jackson on Jun. 12, 1998, entitled "ELECTROSTATIC SEPARATION OF PARTICLES", also assigned to the assignee of the present invention. Both disclose and claim separation apparatus employing tubular electrodes and tubular brushes for cleaning the electrodes in machines designed to separate a mixture of types of particles into their component parts so as to recover particles of one type separated from particles of a second type.

BRIEF SUMMARY OF THE INVENTION

This invention describes and claims a novel electrostatic electrode in the shape of a thin rectangular hollow box having a frame, two large rectangular parallel panels joined to the frame and two slender side panels, and leaving a hollow interior space open at the top and at the bottom of the box. One or more of the box-electrodes of this invention are placed on opposite sides of a central vertical feed zone facing each other. The large panel of each electrode facing the feed zones is constructed of a perforated plate material that will allow the charged particles to pass through the perforations. The frame, back and front plates of the box-electrode are electrically conductive and are charged by a high voltage. The bottom side of the box-electrode is open, as described above to allow particles to pass from the bottom of the electrodes.

The separation apparatus and method of this invention includes two or more box-electrodes, described above, aligned on opposite sides of a feed chute that directs feed particles into the space between electrodes where the particles are subjected to an electrostatic charge as the particles fall through the charging zone. The charged particles are diverted toward the appropriate box-electrode, which is suspended on vibration isolators to allow the electrodes to be vibrated without vibrating the rest of the separator apparatus to shake any clinging particles from the electrodes. The particles eventually fall through a splitter zone which separates the particles diverted by the electrostatic charge from the particles that were unaffected by the charge.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

FIG. 5A showing no vibration; FIG. 5B showing a vibration force pushing the electrode vertically downward; and FIG. 5C showing a vibration force pushing the electrode upward.

DETAILED DESCRIPTION OF THE INVENTION

This invention relates to an apparatus for separating different types of particles by the use of the fact that particles have unique reactions to being subjected to an electrostatically charged atmosphere. Some particles accept the electrostatic charge and change their own charge, and others reject the charge or ignore the charge. The particles may or may not be drawn toward the source of the charge, but in any event the path of the falling particle often is altered by falling through an atmosphere of electrostatic charges, and this alteration provides a means for physically separating one type of particle from another. This scientific principle is well-known in the art today and has been used to separate particles of different types. The present invention employs a novel electrode that has been found to be useful in such separation procedures. The main feature of novelty is the structure and shape of the electrode of this invention.

Figure 1:
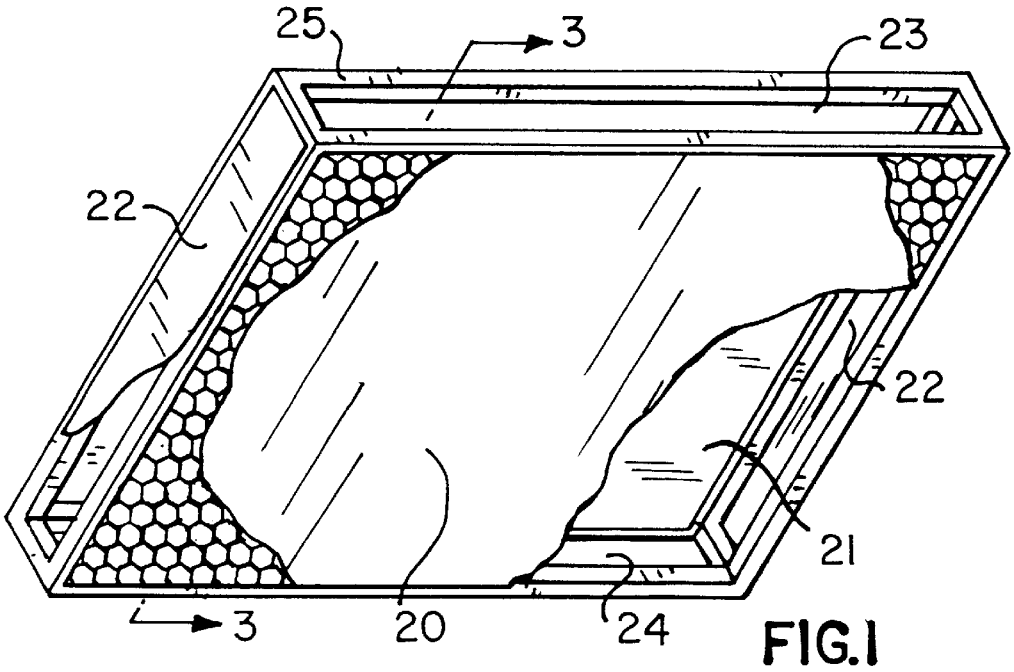
FIG. 1 is a simplified perspective view of the box-electrode of this invention.
Figure 2:
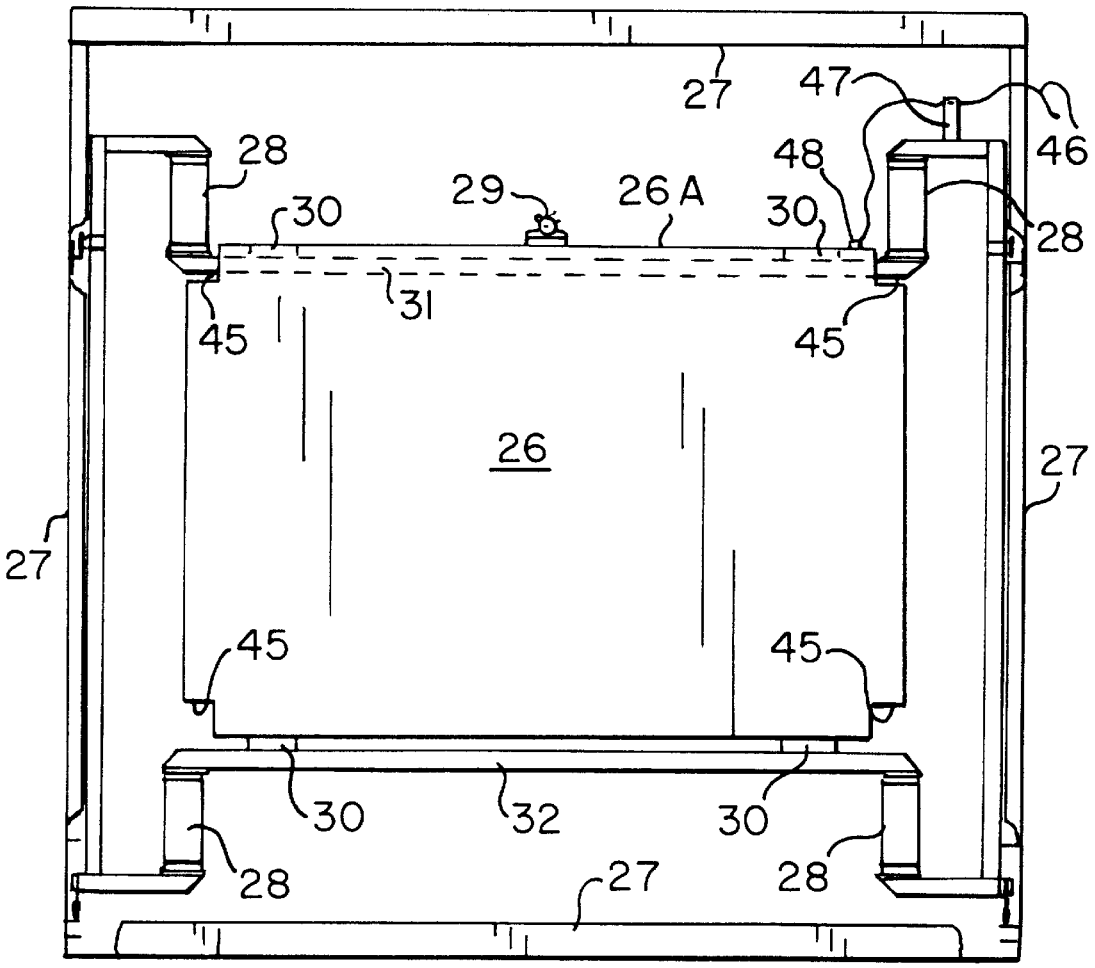
FIG. 2 is a front elevational view of the box-electrode of FIG. 1 in a frame of the electrostatic separation apparatus of this invention, wherein the frame isolates the vibrational motion applied to the box-electrode from the apparatus which houses the frame.
Figure 4:
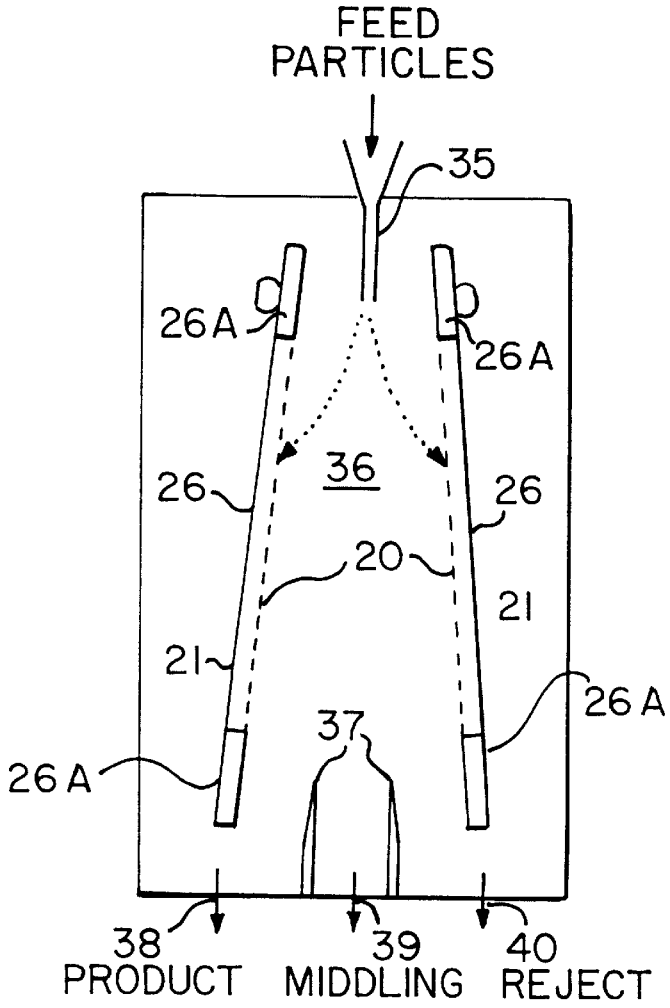
FIG. 4 is a vertical pictorial cross-sectional view of the feed chute of the separation apparatus of the apparatus of this invention showing the general arrangement of the electrodes and the splitter.

With respect generally to FIGS. 1, 2 and 4 the electrode of this invention is shown in the form of a thin rectangular box having two large parallel vertical faces or panels joined together by two narrow parallel vertical strips. These pieces are joined together to enclose a large thin space that is enclosed on the front and back by the two large panels and is enclosed at the two ends by two vertical strips, and has a central hollow with an opening at the bottom. The large face panel is porous to allow the passage of particles therethrough and the large back panel as well as the two end strips are solid electrical conductors, preferably metal sheets.

The separation apparatus of this invention comprises two or more of the box-electrodes described above and separated by a central space 36 through which the particles to be separated are permitted to fall by gravity from a feed hopper located at the upper end of the free-fall space 36 to a splitter 37 located at the lower end of the free-fall space 36, and thence into collection bins 38, 39, 40 to receive the separated particles. The box-electrodes are arranged with their face panels 20 forming the outside limits of the free-fall space 36 and their back panels 21 spaced outwardly away from the face panels 20. The apparatus includes vibrators 29 to shake the electrodes to remove as much as possible of the particles that may cling to the electrodes and to cause the particles to fall toward the splitter 37 and be separated from other particles. The electrodes only must be vibrated but the remainder of the apparatus should be free of any vibration, and so the apparatus includes vibration isolators 30 (see FIG. 2 or 30, 33, 34 in FIG. 3) that confine the vibration to the electrodes and prevent the vibration from shaking any of the rest of the equipment. The splitter 37 consists of two movable knife edges that are positioned with their sharp edges facing the downwardly falling particle and thereby they split the product particles in two or more streams according to their positions in the falling mass of particles. The electrical attraction of the electrodes diverts the falling particles into the portion of the falling stream that corresponds to the electrical attraction and the splitter(s) divides the particles into two or three streams, i.e., desired product, middling, and reject stream, and thus a separation is accomplished.

In FIG. 1 of the attached drawings there is shown the box-electrode of the present invention. The box-electrode has two broad panels (front panel 20 and back panel 21) separated by two end panels 22 to form a thin boxy internal space which may have an upper opening 23 and does have a lower opening 24. The entire skeleton frame structure 26A of the electrode 26 is formed by joining comer struts 25 to which panels 20, 21, and 22 can be attached. Front panel 20 is porous so as to permit charged feed particles to pass through to reach electrified back panel 21, which preferably is an impervious metallic sheet. End panels 22 are also impervious metallic sheets. The feed particles are fed into a chute 35 (see FIG. 4) leading into a space 36 separating two facing electrodes that are charged electrostatically forming an electric field between the electrodes that causes the previously charged particles to be attracted to, repulsed by, or unaffected by the electrostatic field between the facing electrodes. The porosity of panel 20 allows charged particles to pass through it, but the charges in the charged particles may change causing the particle to be attracted to the opposite electrode. Once the particle is inside the box-electrode 26 it is in the zone of zero electrostatic field gradient. In any event it is important to allow the particle to move in any direction it chooses, and if the charge becomes essentially zero, the particle essentially falls downward due to gravity and so the open panel space 24 in the bottom of the electrode frame is important. Nevertheless, some of the particles will tend to accumulate at panel 21 and they must be removed to allow the electrode to continue to operate. To assist in keeping the electrode surface clean, it is provided with a vibratory movement to shake the particles away from the electrode surface and allow them to fall by gravity into a collection zone for safekeeping and/or for reworking to separate out the valuable particles and to dispose of the unwanted particles.

In FIG. 2 there is shown the manner in which the preferred electrode is mounted in the separation apparatus to permit the electrode to be vibrated while the remainder of the apparatus is not vibrated. The electrode 26 (described in more detail in FIG. 1) is housed in a frame 26A that is insulated electrically from the housing 27 by insulators 28. High voltage is applied to electrode 26 by cable 46. Cable 46 is loosely supported by arm 47 extending from housing 27 and connected to the frame 26A by a bolt(s) 48 or other well-known means so that a high voltage may be applied to the electrode 26. The cable 46 has slack so that the electrode 26 may be vibrated by eccentric mechanism 29. Electrode 26 is supported by upper beam 31 and lower beam 32 with isolators 30 separating the electrode from the housing 27 and from the remainder of the apparatus housing the electrodes. Thus, electrode 26 may be vibrated by eccentric 29 while the combination of isolators 30 will confine the vibration to the electrode and not allow it to shake the remainder of the apparatus. The eccentric vibrator produces a shaking motion by rotating on an off-center basis and the vibrations produced thereby are modified to a more acceptable cycle by causing the springs 33 and 34 to actually allow the shaking vibrations of the electrode. These details are illustrated in some detail in FIG. 3.

In practice, electrode 26 is modified by forming cutouts 45 to accommodate bar 31 and insulator 28, as shown. A single type of electrode 26 can be used either to gather product or reject product as illustrated in FIG. 4.

Figure 3:
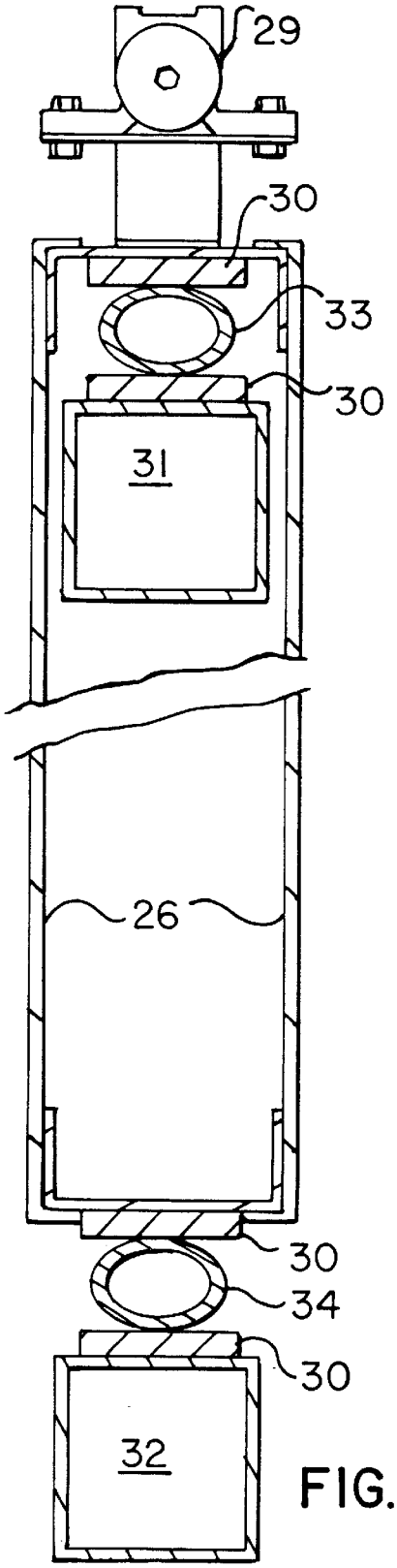
FIG. 3 is a vertical cross-sectional view taken at 3—3 of FIG. 1.
Figure 5:
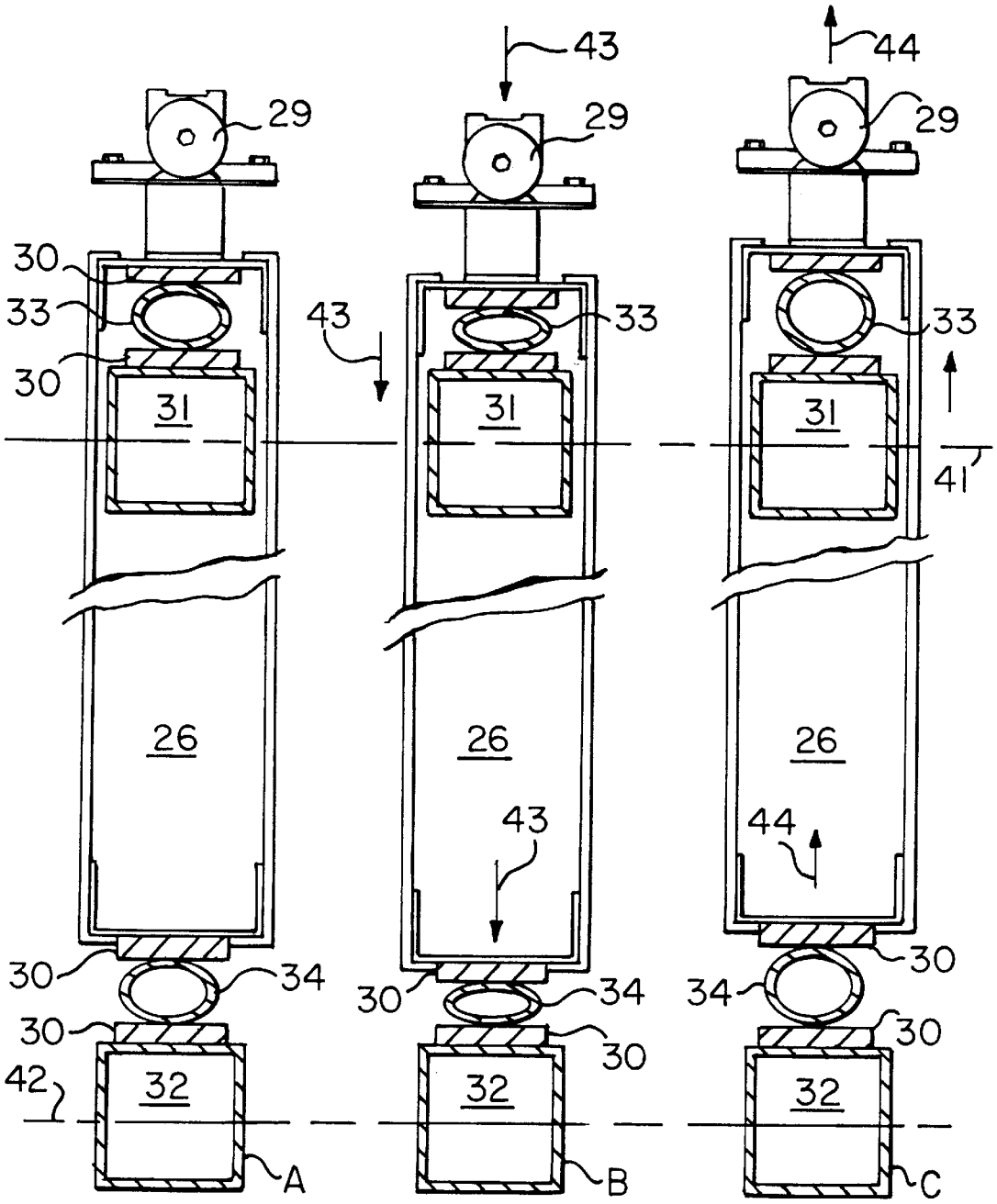
FIG. 5 shows three similar vertical cross-sectional views of an electrode of this invention indicating the movements associated with the vibration of the electrode.

FIG. 5 shows the workings of the vibrator 29 of FIGS. 2 and 3. The vibration mechanism is a rotating eccentric weight usually working in combination with one or more springs 33, 34 and a mass (electrode 26), which allows the electrode 26 to vibrate and prevents the vibration energy from reaching the housing 27. FIG. 5A shows the mechanism in a central neutral position supported by upper beam 31 and lower beam 32. Centerlines 41 and 42 show that the beams 31 and 32 do not move during the vibrations produced by vibrator 29. Springs 33 and 34 compress then expand during the vibrations produced. FIG. 5B shows the positions of the components when the vibrator 29 has reached its full downward position as shown by the large arrows 43. Springs 33 and 34 in FIG. 5B are compressed. In the up position shown in FIG. 5C the springs 33 and 34 are expanded to their full open position (arrow 44). Meanwhile, during these reciprocating movements the electrodes move up and down but the supporting frame of the apparatus remains stationary as seen by the fact that the centerlines 41 and 42 remain centered in the support beams 31 and 32.

Vibrator 29 is a commercially available device that may be secured to an electrode 26 by bolting, welding, or other means as understood in the art.

When feed particles are subject to an electric field created by flat-plate electrodes, the applied force on a particle is determined by the net charge on the particle and the acting electrostatic field strength, i.e.,:

$$F_1 = qE \tag{1}$$

where $F_1$ is the electrostatic force of attraction (or repulsion), q is the charge induced on the particle and E is the electrostatic field strength acting between such electrodes. This Equation 1 is valid for conventional electrostatic separators which use only flat-plate electrodes where there is a uniform electric field acting between the electrodes along the whole length of the plates. As a result, the only force acting on the particles is that due to the charges on the surfaces of the particles. For a non-uniform electric field, an additional force must be considered due to the spatial variations in the electric field (or the gradient of the electric field). This additional force is given by:

$$F_2=k\nabla(E) \quad (2)$$

where $\nabla(E)$ describes the electrical field gradient and k is a constant derived from experimental measurements. Therefore, the total force acting on particles passing through a non-uniform electrostatic field is obtained by the summation of $F_1$ and $F_2$, i.e.,:

$$F_t=F_1+F_2=qE+k\nabla(E) \quad (3)$$

A distinct feature of the box-electrode 26 set forth herein is that it creates a sheltered area with less field gradient and prevents particles from bouncing back after they have been attracted to the correct positive or negative electrode. This result can be attributed to the particles being attracted and passing through the perforated electrode (FIG. 1, front panel 20) and the gradient of the electric field between front panel 20 and back panel 21 being negligible. Therefore, the second term in Equation (3) is reduced and the particles can be more easily removed from the electric field by a combination of gravitational force and mechanical assistance, as by the vibrators 29.

Figure 6:
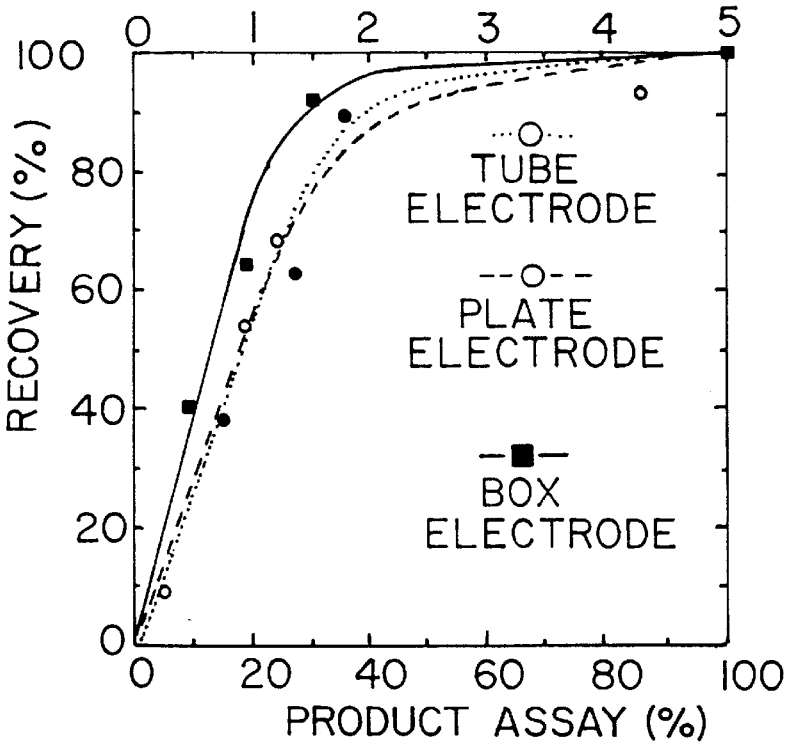
FIG. 6 is a graph of the recovery % vs. the product assay % comparing the separation efficiencies of two prior art electrodes with that of the box-electrode of the present invention.

FIG. 6 shows graphically that the box-electrode of this invention performs more efficiently than the prior art tube electrode or plate electrode. Higher recovery percentages are experienced by the box-electrode at a lower product assay percentage than that shown by either of the prior art separation systems.

As may be determined from the above description of the apparatus, the method for electrostatically separating a feed mixture of two types of particles according to this invention includes feeding the mixture into the upper end of a free-fall space between two spaced rectangular electrodes positioned on opposite sides of the free-fall space as mirror-images of each other with each electrode including a frame, a perforated electrically conductive faceplate, and an electrically conductive solid back plate parallel to each other and forming with the frame a thin box-shaped space; applying a high voltage to oppositely charge the electrodes by which the faceplate and back plate are at the same voltage to minimize the electric gradient therebetween thereby enhancing particle separation; passing oppositely charged electrostatic feed particles through the perforated plates to the back plates of the electrodes; and recovering separated particles from the electrodes.

The method may also include directing separated particles in the free-fall space into an adjustable splitter adjacent a lower end of the free-fall space; and collecting the recovered particle middlings generally centrally with particle rejects being adjacent one electrode and particle products being adjacent the other electrode.

The method further includes vibrating the frame to cause any particles temporarily stuck to an electrode to be shaken therefrom.

The mounting of vibration isolators between the electrodes and the support to isolate vibrations from each vibrator from passing through the support is preferred. The mounting of one support within and in a top portion of an electrode and another support below a bottom of an electrode provides control for the up and down vibrations of the electrodes. In addition, the vibration isolators provide the necessary support to permit the electrodes to be at angles other than vertical, as shown, for example, in FIG. 4 or with a larger distance at the top than at the bottom of electrodes.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An apparatus for electrostatically separating a feed mixture of two types of particles comprising two rectangular charged electrodes positioned on opposite sides of a free-fall space for attracting oppositely electrically charged particles therefrom, each said electrode including a frame having a front plate, and a back plate joined to each other by two vertical end panels to at least partially enclose a thin box-shaped space with an open bottom, said front plate of each electrode being a perforated panel for passing feed particles therethrough, one said electrode being charged by an electrical charge opposite to that of another said electrode, and each said front plate and back plate of each said electrode being charged with the same electrical charge thereby creating zero electrostatic field gradient inside each space of each said electrode to permit feed particles inside each said electrode to freely fall by gravity through said open bottom of each said electrode.

2. The apparatus of claim 1 wherein said front plate is a metallic screen.

3. The apparatus of claim 1 wherein said back plate and said end panels are metal sheets.

4. The apparatus of claim 1 further comprising an adjustable splitter adjacent a lower end of the said free-fall space, having a collection zone to receive particle middlings with particle rejects being adjacent one of said electrodes and particle products being adjacent another said electrode.

5. The apparatus of claim 1 wherein each said electrode includes a vibrator attached to said frame, said vibrator providing vibrations to said electrode to cause any particles temporarily stuck to said electrode to be shaken therefrom.

6. The apparatus of claim 5 further comprising a housing, stationary support means for mounting said electrodes in said housing, vibration isolators positioned between said electrodes and said support means to isolate vibrations from each said vibrator from passing through said support means.

7. The apparatus of claim 6 wherein one said support means is located within and in a top portion of said electrode and another said support means is located below a bottom of said electrode.

8. The apparatus of claim 6 wherein said vibration isolators include a top pair of spaced isolators and a bottom pair of spaced isolators, all said isolators being adjacent respective corners of each said electrode.

9. The apparatus of claim 1 wherein said electrodes are angled from vertical and with respect to each other.

10. The apparatus of claim 1 further comprising a housing and stationary support means for said electrodes, high voltage insulators between said housing and said support means to permit connection of said means for applying a high voltage of opposite charge respectively to said electrodes.

11. An apparatus for electrostatically separating a feed mixture of two types of particles comprising two electrodes positioned on opposite sides of a free-fall space for attracting oppositely electrically charged particles therefrom, each said electrode including a frame having a front plate and a back plate rigidly joined together, said front plate of each said electrode being a perforated panel for passing feed particles therethrough, one said electrode being charged by an electrical charge opposite to that of another said electrode, and each said front plate and back plate of each said electrode being charged with the same electrical charge thereby creating zero electrostatic field gradient inside each said electrode to prevent feed particles passing through said perforated first panel from bouncing back from said back plate and to permit said particles to freely fall by gravity inside each said electrode through said open bottom of each said electrode.

12. The apparatus of claim 11 wherein each said electrode comprises a pair of vertical end panels attached to said frame and at least partially enclosing said box-shaped space, said back plate and said end panels being metal sheets.

13. The apparatus of claim 11 wherein each said electrode includes a vibrator attached to said frame, said vibrator providing vibrations to said electrode to cause any particles temporarily stuck to said electrode to be shaken therefrom.

14. The apparatus of claim 13 further comprising a housing, stationary support means for mounting said electrodes in said housing, vibration isolators positioned between said electrodes and said support means to isolate vibrations from each said vibrator from passing through said support means.

15. The apparatus of claim 14 wherein one said support means is located within and in a top portion of each said electrode and another said support means is located below a bottom of each said electrode.

16. A method for electrostatically separating a feed mixture of two types of particles comprising the steps of:

A. providing two electrode enclosures;

B. charging one enclosure by an electric charge throughout the enclosure to create a zero electrostatic field gradient inside the enclosure;

C. charging the other enclosure by an electric charge throughout the enclosure to create a zero electrostatic field gradient inside the enclosure, the other enclosure having an electrical charge opposite to that of the one enclosure;

D. positioning the two electrodes enclosures directly opposite from each other inside a free-fall space;

E. feeding the mixture into the free-fall space;

F. electrostatically attracting oppositely charged feed particles respectively to the two electrode enclosures;

G. passing the attracted particles inside the electrode enclosures through the zero electrostatic field gradient;

H. permitting the particles to fall freely by gravity; and

I. collecting the fallen separated particles.

17. The method of claim 16 wherein step I includes the steps of:

J. directing separated particles in the free-fall space into an adjustable splitter adjacent a lower end of the free-fall space; and K. collecting the recovered particle middlings generally centrally with particle rejects being adjacent one electrode and particles products being adjacent the other electrode.

18. The method of claim 16 further including the steps of:

L. vibrating the frame to cause any particles temporarily stuck to an electrode to be shaken therefrom.

19. The method of claim 18 wherein step L includes the step of:

M. mounting vibration isolaters between the electrodes and the support to isolate vibrations from each other from passing through the support.

20. The method of claim 19 further including the step of:

N. mounting one support within and in a top portion of an electrode and another support below a bottom of an electrode.

* * * * *